US010843853B2

(12) United States Patent
Morrissey

(10) Patent No.: US 10,843,853 B2
(45) Date of Patent: Nov. 24, 2020

(54) RESEALABLE CLOSURE FOR A BEVERAGE CONTAINER INCLUDING CONCEALED ELECTRONIC DEVICE

(71) Applicant: Brian J Morrissey, Evansville, IN (US)

(72) Inventor: Brian J Morrissey, Evansville, IN (US)

( * ) Notice: Subject to any disclaimer, the term of this patent is extended or adjusted under 35 U.S.C. 154(b) by 188 days.

(21) Appl. No.: 15/998,264

(22) Filed: Jul. 25, 2018

(65) Prior Publication Data

US 2020/0031542 A1 Jan. 30, 2020

(51) Int. Cl.

| | |
|---|---|
| ***B65D 17/50*** | (2006.01) |
| ***B65D 51/24*** | (2006.01) |
| ***B65D 47/08*** | (2006.01) |
| ***B65D 55/02*** | (2006.01) |
| ***B65D 51/00*** | (2006.01) |
| *B65D 51/16* | (2006.01) |

(52) U.S. Cl.

CPC ..... *B65D 51/248* (2013.01); *B65D 17/506* (2013.01); *B65D 47/0857* (2013.01); *B65D 51/007* (2013.01); *B65D 55/028* (2013.01); *B65D 51/1672* (2013.01); *B65D 2401/15* (2020.05); *B65D 2517/002* (2013.01); *B65D 2517/0007* (2013.01); *B65D 2517/0038* (2013.01); *B65D 2517/0053* (2013.01); *B65D 2517/0091* (2013.01)

(58) Field of Classification Search

CPC ..... B65D 17/506; B65D 51/007; B65D 51/1683; B65D 55/028; B65D 55/026

See application file for complete search history.

(56) References Cited

U.S. PATENT DOCUMENTS

| | | | | |
|---|---|---|---|---|
| 2007/0164026 | A1* | 7/2007 | Morrissey | B65D 17/506 220/254.3 |
| 2008/0111685 | A1* | 5/2008 | Olson | G10L 21/00 340/545.6 |
| 2009/0127283 | A1* | 5/2009 | Smith | G06K 19/073 222/25 |
| 2014/0341411 | A1* | 11/2014 | Mohindra | B65D 55/028 381/334 |

* cited by examiner

*Primary Examiner* — Mollie Impink

(57) ABSTRACT

A closure for containers providing a seal when closed. A pull tab lifted to open provides a venting action, and a pour opening. A sanitary platform covers a drinking area around the pour opening. Closure contains electronic device components triggered to engage a user in games of chance through the use of a cellular phone.

6 Claims, 4 Drawing Sheets

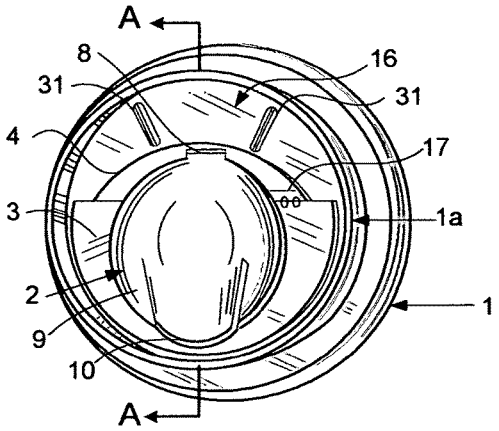
FIG. 1
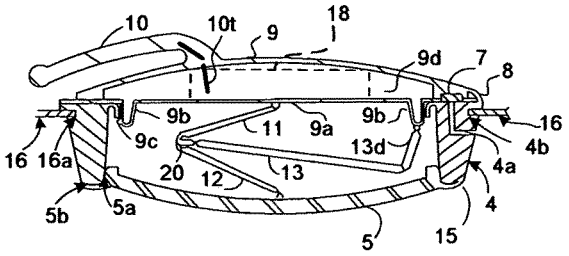
FIG. 2 View through AA
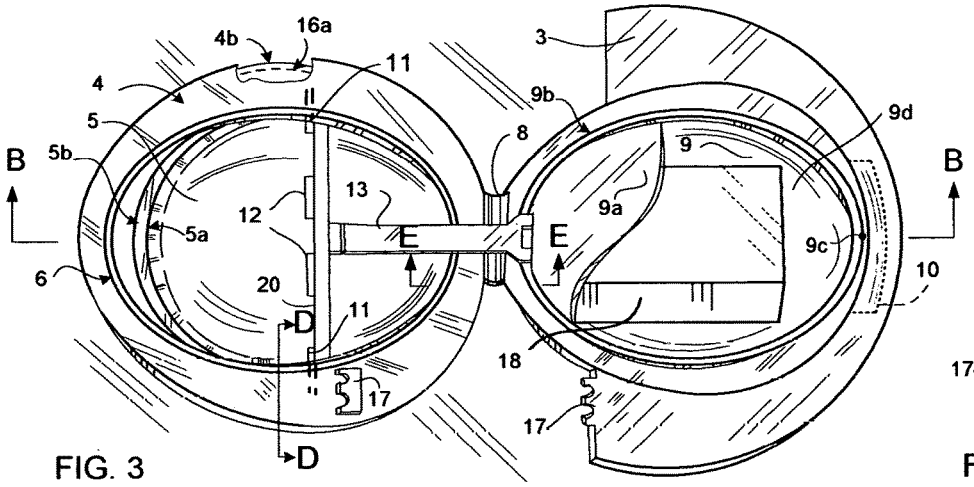
FIG. 3
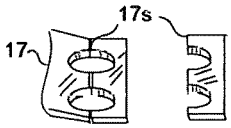
FIG 3a
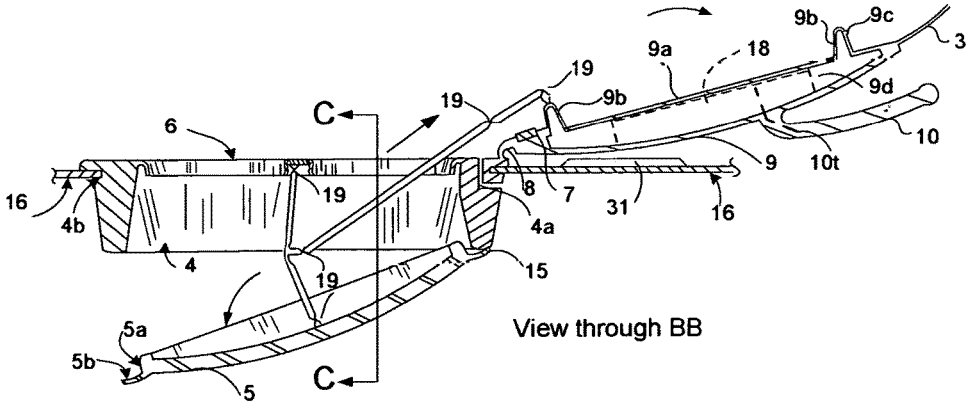
FIG. 4

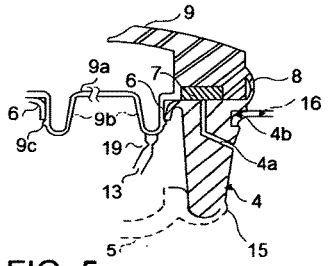
FIG. 5
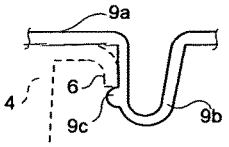
Fig. 5a
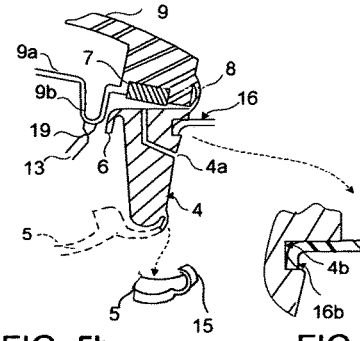
FIG. 5b
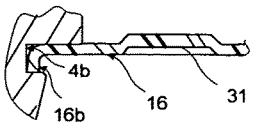
FIG. 5c
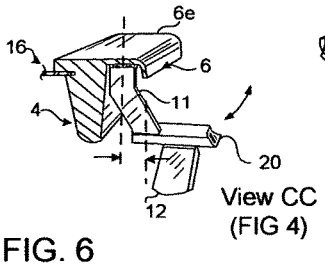
FIG. 6
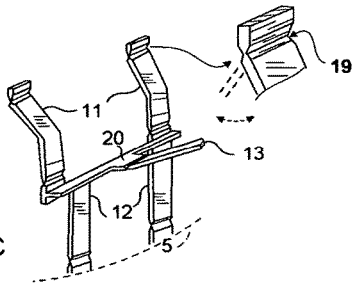
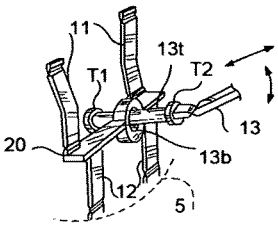
FIG.7
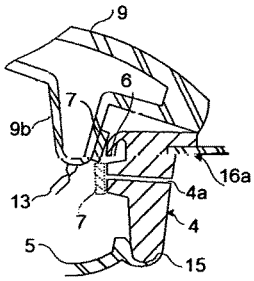
FIG. 8
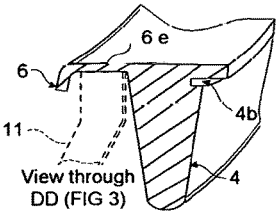
FIG. 9
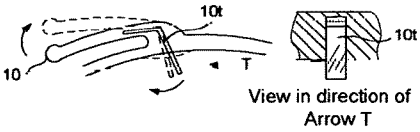
FIG. 9t
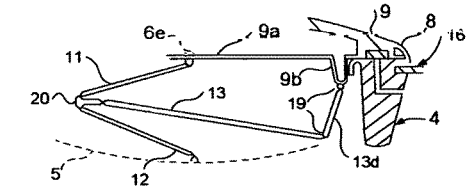
FIG. 10
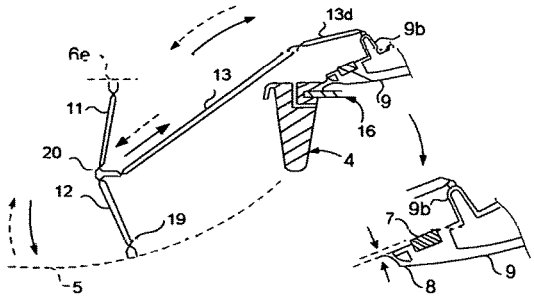
FIG. 11

RESEALABLE CLOSURE FOR A BEVERAGE CONTAINER INCLUDING CONCEALED ELECTRONIC DEVICE

RELATED APPLICATION

Prior application Ser. No. 11/324,527. Jan. 4, 2006. is contained by reference.

BACKGROUND OF THE INVENTION

Two major types of conventional beverage containers are available to supply consumers with an easy use container that is both conveniently sized and contains a convenient product amount.

One type, an aluminum beverage container, has an attached aluminum pull tab attached to the lid of a can that, when lifted, separates a scored panel in the can lid, producing a pour opening, giving access to the product. This method of opening does not support the ability to reclose and seal the beverage not consumed. As well as liquid, the sealing of high pressure gasses, forming in the can, also has to be sealed.

Sanitary concerns with contaminates present on the drinking area are troublesome.

Problems around the drinking area include the accumulation of dust or other undesirable material present, by containers being stored over time prior to purchase and use.

Without the ability to reseal the can, the product deteriorates through the loss of carbonated gasses, leaving the product unacceptable to the consumer, termed as being flat, the contents have to be disposed of, which may be inappropriate, and are wasteful.

Another container type is a plastic bottle, which is resealable. A removable cap is unscrewed from the bottle neck to provide a pour opening. This sealing method requires replacing the sealing cap to effect a seal, however the loss of the cap by accident, or design leaves the product unsealed and be discarded for the same reasons. The loss of the screw cap poses an additional problem, as this small plastic cap is problematic as pollution, being so small as to wash into storm drains, or make retrieving difficult. In both cases, transporting an open can or bottle can lead to spillage, for example in a bag or other container.

Past efforts have introduced electronic devices into bottle caps to entertain and engage users in games of chance, U.S. Pat. No. 6,545,594 is an example.

SUMMARY OF THE INVENTION

Accordingly, the benefits and desirable features provided by a plastic, self contained closure inserted into the lid of an aluminum beverage can, providing a liquid and gas tight seal is provided. In one embodiment a clam shell structure, having an upwardly rotatable upper panel, a mid portion rim seal inserted into and surrounding an aperture formed in a can lid there through, providing a pour opening. Included is a downwardly rotatable lower internal panel.

Lifting and rotating the upper panel selectively vents high pressure gas from the interior headspace of the can, or conserves high pressure gas required for product freshness within the can. With the high pressure removed, an easy opening lower internal panel is downwardly rotated into the interior of the can providing a pour opening.

The upper panel includes an extension to cover the drinking area surrounding the pour opening, such that a sanitary platform prevents contamination of this area, and is removed to a different location as the pour opening is presented for drinking or pouring.

Reversing the opening sequence replaces the lower internal panel into an original position, forming a liquid and gas tight seal. The upper panel is returned into an original first position when the closure is closed.

To take advantage of available and increasing technology developments such as electronic devices, the upper panel contains a sealed chamber of sufficient size to encase several electronic chips having audio, light source and other capabilities within. Commercially available containers have lower structures containing a variety of product, and have upper structures attached having a means to deliver such product.

These upper structures are by necessity large enough to operate by a user, and areas within such structures have available space and are provided with electronic device components. Various functions of the electronic device, but not limited to, is to entertain and inform users.

BRIEF DESCRIPTION OF THE DRAWINGS

FIG. 1 is a top perspective view of a combination of a re-sealable closure set into, and covering a portion of an aluminum beverage can end, in a first closed embodiment.

FIG. 2. is a cross sectional view of the first embodiment in a fully closed position and shows an upper panel structure, a central rim seal structure, and a lower panel structure.

FIG. 3 is a plan view of the first embodiment in a fully open position, having a portion tom away to reveal an enclosed electronic device.

FIG. 3*a* is an enlarged view of a tear apart tamper evident structure.

FIG. 4 is a cross sectional view of the first embodiment in a fully open position.

FIG. 5, FIG. 5*a*, FIG. 5*b*, and FIG. 5*c*, are enlarged views and details through an area proximate a hinge location FIG. 6 show various views of actuating levers members shown in a partial to fully open positions.

FIG. 7. shows a structure having a sliding member positioned between two terminals.

FIG. 8 is a view of a different embodiment detailing an alternative vent channel sealing arrangement.

FIG. 9 is a perspective cross section through a rim seal, detailing an extension to accommodate a lever connection.

FIG. 9*t* is a view through a pull tab structure showing a narrow substantially rigid plastic member FIG. 10 and FIG. 11 are cross sectional views of the connections and relationships of the actuating levers.

DETAILED DESCRIPTION OT THE INVENTION

Figure 12:
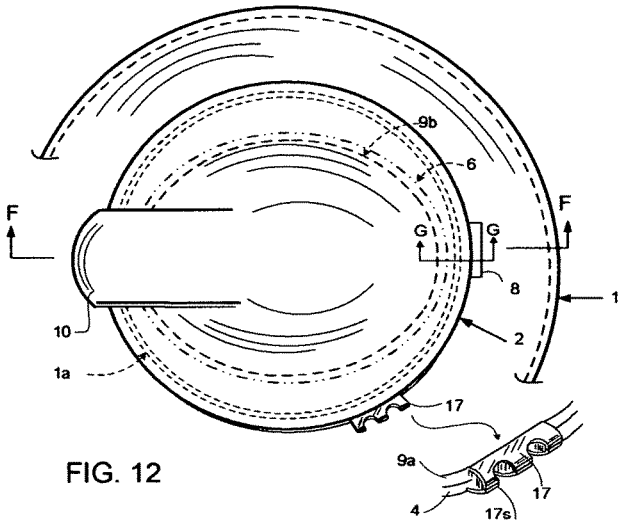
FIG. 12 is a top view of a thermoplastic beverage container of a second embodiment, showing a closure in place attached to the container neck, and a close up of a tear apart tamper evident structure.

The present invention provides a re-closable gas and liquid tight seal for use in an aluminum beverage can, and on thermoplastic beverage containers. The operating principle of the closures are the same, different attachment requirements for aluminum beverage cans, and thermoplastic beverage containers are provided. Several aspects of the embodiments below illustrate various functions or methods, and are not intended to be limiting on the present invention. Like numerals refer to like parts through the drawings.

Referring now to more details of the drawings, FIG. 1 shows a top perspective view of an aluminum beverage can 1 and can end 1*a*, with a closure attachment 2 of a first embodiment of the present invention. Included are rim seal 4 and domed shaped upper panel 9, including pull tab 10, and an integrated sanitary platform 3, positioned to cover a drinking area surrounding closure 2. Stiffing ribs 31 are indicated on a 16 planer portion of can lid 1*a*. A visible tear apart tamper evident structure 17, attached to both rim seal 4 and sanitary platform 3 is included and shown in a first, fully attached position.

FIG. 2 is a cross sectional view through AA and shows the closure 2 in a fully closed position. Rim seal 4 includes a depending wall having a double taper. The outer slope, narrow at a lower position, assists insertion through aperture 16*a*, the inner slope matching the connection of lower internal panel 5 circumferential sealing areas 5*a* and 5*b*. Groove 4*b* is circumferentially sized to snap into orifice 16*a* in a tight sealing relationship, surrounded by planer section 16 of can end 1*a*.

Lower internal panel 5 and depending wall 4 are positioned within the interior of can 1, and are subjected to high pressure gas in can 1 headspace. This pressure acting to more fully engage the sealing surfaces 5*a* and 5*b* in contact between lower internal seal 5 and depending wall 4, and compressing peripheral area of the outer slope of depending wall 4.

This pressure also tends to lift, or cause a doming of can lid 1, but is resisted FIG. 5*b* and FIG. 5*c* by a rim, 16*b*, pressed inwardly around orifice 16*a*, toward can 1 interior, cooperating within groove 4*b*, and pressed ribs 31 together adding rigidity to can lid 16.

Figure 19:
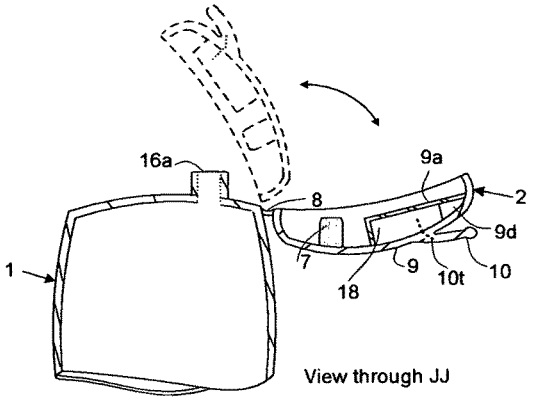
FIG. 19 is a view through line JJ FIG. 18 cross sectional view of an open closure attached to a container at an upper location.

FIG. 2, show actuating lever members 11,12,13,13*d*, and 20 in a first folded position, and in FIG. 3 and FIG. 4, a second extended position. Levers consist of the above member and is also seen in FIG. 19 and FIG. 11. To gain another perspective FIG. 6 and FIG. 9 details the relationship and connections View CC FIG. 4, of the linkage from different points of view.

Upper lever 11 is shown attached at rim seal 4 extension 6*e* of lip seal 6 to allow rotation under the lip seal at the widest position. Dotted lines indicate an offset between an upper connection 11, and a lower connection at horizontal member 20, for the same reason. Of note enlarged hinge 19, is a common connection used throughout the actuating levers, and is best seen in FIG. 6. enlarged view of hinge 19 includes two substantially opposed members connected by a thin section of flexible plastic allowing rotation, as found on many commercially available plastic containers of various types.

FIG. 2 and FIG. 4 show attached to lower panel 9*a* a circumferential depending wall 9*b*. Also shown is a circumferential lip seal 6, being part of rim seal 4 set at an upper location. In a first position, depending wall 9*b* is inserted into lip seal 6, and sized to provide a liquid sealing relationship between depending wall 9*b*, and lip seal 6. FIG. 5 and FIG. 5*b* show this connection, 9*b* having an outer portion, and an inner portion, relative to lower planer panel 9*a*, with sealing occurring between seal 6, and outer portion of depending wall 9*b*. In effect a rim seal A second seal occurs between underside of planer panel 9*a* and upper portion of rim seal 4. in effect a flange seal. This liquid sealing relationship is provided for the practice of many users of such beverage containers whereby the containers are immersed in cold water to chill, and maintain a cool beverage drink over time.

The opening sequence starts with lifting pull tab 10 inducing upper panel 9 to rotate around hinge 8. Several simultaneous actions are set in motion as this rotation occurs. Rounded protrusions FIG. 5*a*, 9*c* are removed from contact under lip seal 6. A vent channel 4*a* best seen in FIG. 5 and FIG. 5*b* has a lower end open to the high pressure gas within the can 1 headspace, and is sealed by compressible cover 7 at a distal end. This sealing arrangement is interrupted as the rotation of upper panel 9 lifts compressible cover 7 away from contact at an upper location with channel 4*a*, venting the contained high pressure gas from within the container.

As rotation continues, sanitary platform 3, and tamper evident structure 17, 17*s*, upon tearing apart, are relocated, leaving a clean drinking area and a visual indication that the can has been initially opened to a second extended position, FIG. 11 causing a dimensional increase between the anchor points of levers 11, and 12. Lower panel 5 is forced out of a sealing relationship with depending wall 4, and is rotated open around narrow strip hinge 15, providing a pour opening.

FIG. 3 and FIG. 4. contain another ongoing activity as upper panel 9 is rotating around hinge 8. The upper panel 9 is domed shaped, separated from a planer lower panel portion 9*a*. This forms a sealed chamber 9*d*, between upper and lower panels, 9 and 9*a*, and provides rigidity to the panel. Contained within chamber 9*d* are electronic device components 18.

Upon initial lifting of pull tab 10, the tab is distorted. FIG. 9*t*., a substantially rigid plastic strip 10*t* is embedded within pull tab 10 at a connection to upper panel 9 location at one end, extending to a lower point, and is repositioned by this distortion, providing movement engaging triggering mechanism 10*t* to activate electronic device components 18 at a distal end. More details later.

FIG. 5*a* is an enlarged view of depending wall 9*b*, show in an as sealed position. Round protrusion 9*c* is illustrated attached to the aforementioned outer portion, having flexed seal 6, and sprung back to capture protrusion 9*c* in a closed position. One or more of the rounded protrusions 9*c* may be attached to depending wall FIG. 3. 9*b*, at or near a longitudinal centerline of closure 2, and opposite to hinge 8. Shown in FIG. 4 and FIG. 5*b* is an enlarged view of a narrow strip 15 that acts as a hinge connecting lower internal panel 5 to depending wall 4 at a lower position. This arrangement allows panel 5 to rotate between a first closed position, and a second open position, providing a pour opening, supported at three connections, 12, (2) and 15.(1).

Thus upper panel 9 is rotated approximately 170 degrees around hinge 8 into a non intrusive position for drinking or pouring of the beverage product. High pressure gasses have been vented. Sanitary platform 3 has been removed to uncovered a clean drinking area surrounding closure 2, and tamper evident structure 17 is visually, permanently separated. Audio messages 18 have been introduced and delivered leaving a consumer choices to peruse at leisure.

Returning the levers to a first, folded position, repositioning lower internal panel 5 within and against depending wall 4 at a lower location, engaging sealing circumferential elements 5*a* and 5*b*. Thus lower internal panel 5 is repositioned into a first sealing relationship with depending wall 4, and is responsive to gasses emitting from remaining liquid and building pressure, engaging more fully in a sealing relationship. Sanitary platform 3 is replaced to cover the drinking area surrounding closure 2. Rounded protrusion(s) 9*c* are located under lip seal 6 as stated, locking upper panel 9 in a closed position, preserving the freshness of the remaining beverage.

Upper panel depending wall 9*b* cooperating within lip seal 6 providing a liquid tight cover to the upper panel 9. FIG. 8 is an alternative sealing arrangement, having compressible cover 7 contact at a different location.

In order for the above described articulation of lever members to be achieved, all pressure must be evacuated from the headspace within the can. On initial opening, the can headspace contains gas under high pressure and low volume. On a subsequence opening, depending on the amount of liquid removed, the headspace may contain gas at a lower pressure, but higher volume.

It may be conceived under these conditions that complete evacuation of pressure may need more time, and a delay in the operation of lever actuation to prevent undue force being applied to the levers during rotation of upper panel 9. This problem is addressed in FIG. 7 and FIG. 16. Two spaced apart terminal members, T1 and T2 allow transition 13*t* to slide through horizontal member 20. Best seen in FIG. 13 and FIG. 14. In previous closing, T2, in compression, remains located in contact with member 20, pushing levers 11 and 12 from an extended position, to a first folded position to close lower panel 5.

Subsequent opening allows T1 to slide 13*t* toward horizontal member 20, causing a delay before contact is made with horizontal member 20. At this point the levers, now under tension, begin relocating the levers to provide a pour opening. The extra time, and rotation of upper panel 9, require to slide from contact between T2 to T1 allows the volume of gas to dissipate to atmospheric pressure prior to force being applied to the levers.

Turning now to a closure for a thermoplastic beverage container.

Figure 15:
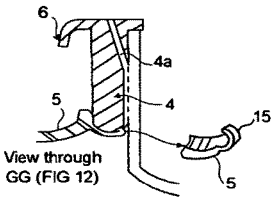
FIG. 15 is a section through a container neck with the closure in place view through GG FIG. 12 detailing a vent channel, and a narrow strip hinge connection a lower panel

FIG. 15 is an enlarged view through GG, indicating depending wall 4 having a perpendicular outer wall in sealing contact within bottle neck 1*a*, and a tapered inner slope, narrow at a lower position, matching the connections of lower internal panel 5 circumferential sealing areas 5*a* and 5*b*. Lower internal panel 5 has a narrow strip of flexible plastic 15 connected to the lower portion of depending wall 4 as a hinge to allow rotation of lower internal panel 5 into the container 1 interior.

Figure 17:
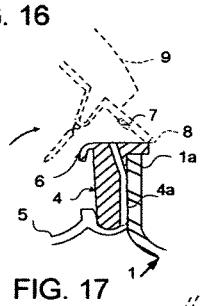
FIG. 17, FIG. 17*a* and FIG. 17*b* offer additional views of the vent channel, and rotation of an upper, and lower panel
Figure 17A:
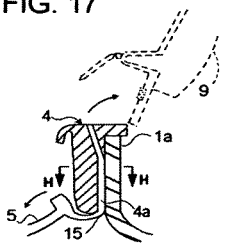
Figure 17B:
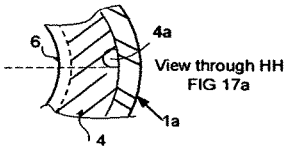

The lower opening to vent 4*a* is slightly offset FIG. 17*b* so that no interference with hinge 15 is encountered. Vent channel 4*a* is sealed at an upper location by compressible cover 7 and is open to high pressure at a lower position within thermoplastic container as previously described.

Figure 14:
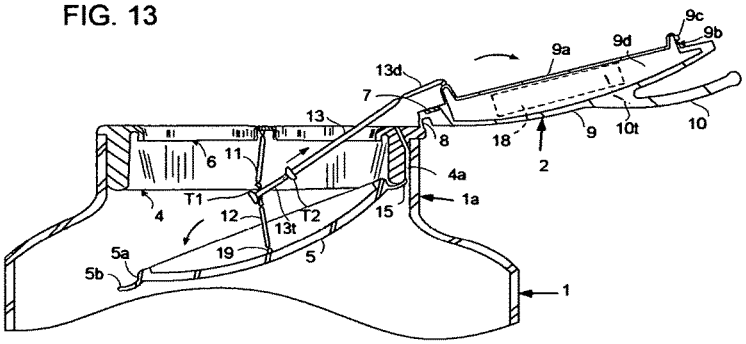
Figure 16:
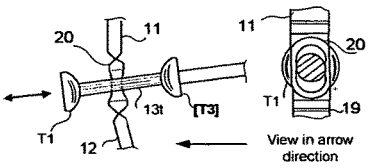
FIG. 16 is an alternative embodiment and is also shown in FIG. 7, allowing a sliding action between two terminals.

FIG. 14 show the closure 2 in a fully open position. The opening sequence starts with lifting pull tab 10 inducing upper panel 9 to rotate around hinge 8 as previously described in detail. FIG. 16 is an enlarged view of a delay mechanism detailing terminals T1 and T2, and actions thereof as described. FIG. 7, FIG. 17, and FIG. 17*a* show details through GG, with rotation of upper panel 9 shown as broken line at different rotational positions. Thus closure 2 has been described in a first, closed position within thermoplastic beverage container neck 1*a*, and in a second, open position providing a pour opening.

Figure 13:
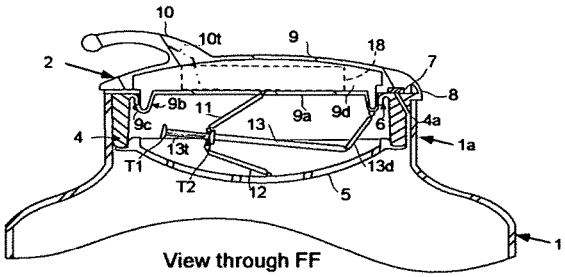
FIG. 13 and FIG. 14 are cross sectional views through a closure in place within a container neck, shown in a first closed, FIG. 13 and a second FIG. 14 open position.

As stated previously, to take advantage of available and increasing technology developments such as electronic devices, there exists an area between a domed structure on an upper panel of the closure, separated from a flat panel on a lower aspect circumferentially connected as shown in FIG. 13, FIG. 14. 9*d*. This area is of sufficient size to embody several electronic chips 18 having audio, light source and other capabilities, within a sealed chamber. The electronic device may provide an entertainment function, and offer rewards to users, and be undetectable by a user until opened.

With the upper panel initially rotating, the electronic chips are triggered and activated. When the panel is rotated to a location where the lower flat panel underside is visible to a user, their attention is drawn to, for example, a light source in the panel, and musical chimes sounding. The electronic chip is programmed to deliver a voice message containing an offer and an invitation with instructions to connect to a users cellular phone, to engage users in games of chance and other data that may be of interest. From their cellular phone the consumer may, at their convenience, peruse a variety of options, including but not limited to prizes, and make selections from data provided that meet their needs or interest.

Incorporating this technology into other types of commercially available containers offer more consumers the opportunity to participate in such games of chance, data exchange, safety instructions, or directions for product use. Other uses included electronic devices contained on medication containers, and could, for example transfer data to a users cellular phone, with dosage, reminders, and when and how to use such medication, or report problems encountered.

Figure 18:
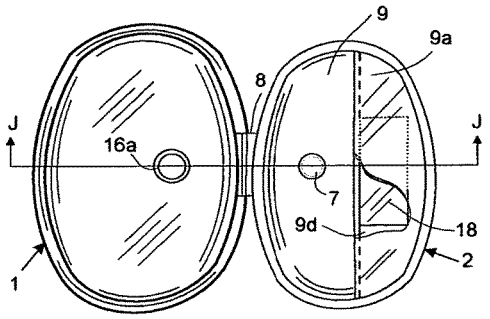
FIG. 18, is a top view of a third embodiment showing a closure attached to a container.
Figure 20:
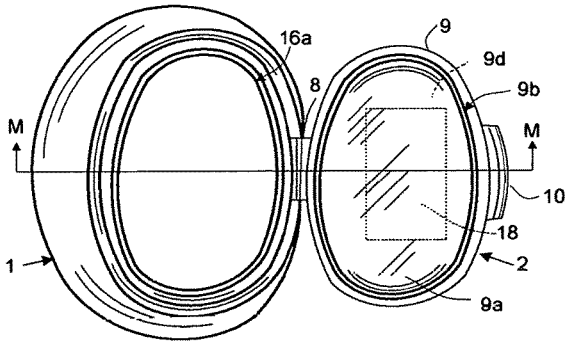
FIG. 20 is a top view of third embodiment showing a closure attached to a container, including a large diameter pour opening (wide mouth) in an open position.
Figure 21:
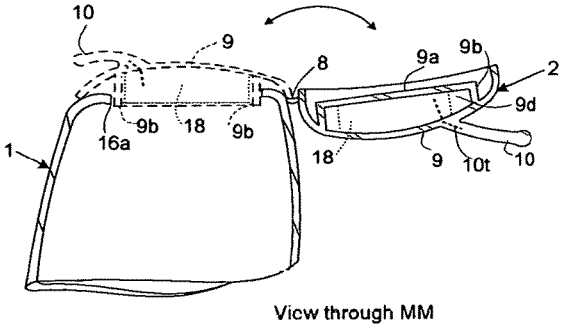
FIG. 21 is a view through line MM FIG. 20 cross sectional view of an open closure attached to a container at an upper location.
Figure 22:
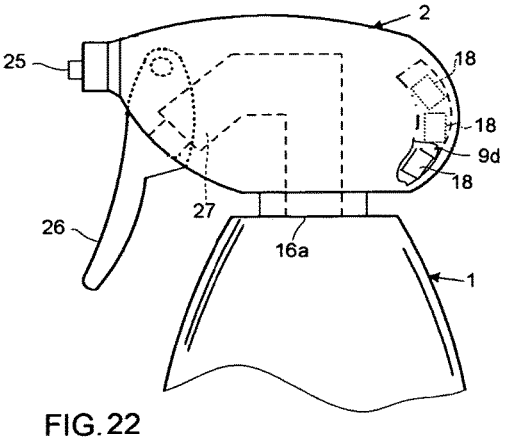
FIG. 22 shows a sectional view through upper structure of a container indicating an attachment position for electronic device components.

Such containers FIG. 18. FIG. 19. FIG. 20. and FIG. 21. having a lower structure 1 configured to provide product storage, a separate but intergraded upper structure 2 providing a means to access the product. Shown are containers fitted with a hinged, rotatable panel 9 providing an open, or closed choice of 16*a* orifice size and location, and 18 electronic component located within. Other containers, FIG. 22. 1 fitted with for example, a manual press and release mechanism, 27 that contain a spray nozzle 25 structure, where a manual finger pull 26 is required to pump product; or a lever is depressed to release pressurized gas that expels the product. (Not Shown.)

Commonly found among these commercially available containers the upper structures, because of the design and functional hand held requirements, are sized sufficiently to provide space needed to incorporate the electronic device components 18 within the upper structure interior, with little modification required and with no interference to their operation. Such containers would contain products that could be liquid, powder, or granular in nature.

Examples are, but not limited to, dairy product containers, detergent containers, personal care products containers, and various cleaning agents.

What is claimed is:

1. A closure assembly for a beverage container, the beverage container having a top portion including an aperture, the closure assembly comprising:

a rim seal comprising a depending wall with a circumferential tapered surface for sealing the aperture, the rim seal having a bottom surface, wherein the rim seal is ring-shaped such that a pour opening is defined within the rim seal;

an upper panel having a liquid sealing relationship with the rim seal when the upper panel is in a closed position, wherein the upper panel is attached to the rim seal by a hinge;

a lower panel comprising circumferential sealing surfaces in sealing relationship with the bottom surface of the rim seal, wherein the lower panel responds to gasses and pressure from within the beverage container by engaging more fully in a sealing relationship with the rim seal;

wherein the upper panel is mechanically connected to the lower panel such that rotation of the upper panel causes rotation of the lower panel in the opposite direction in order to open or close the pour opening, wherein the upper panel includes a concealed electronic device, the concealed electronic device comprises a light source and delivers an audio message containing offers of prizes and a voice message containing instructions.

2. The closure assembly of claim 1, wherein the rim seal includes a venting channel, the venting channel is closed and sealed at a top end when the upper panel is in the closed position, and wherein the venting channel is open and unsealed when the upper panel is in the opened position.

3. The closure assembly of claim 2, wherein the venting channel within the rim seal is located in close proximity to the hinge.

4. The closure assembly of claim 1, wherein the upper panel further comprises a first depending circumferential seal at a lower location; and the rim seal further comprises a second depending circumferential seal extending from the inner circumference of the rim seal, wherein when the upper panel is in the closed position, the first depending circumferential seal contacts the second depending circumferential seal in order to form the liquid sealing relationship.

5. The closure assembly of claim 1, wherein the upper panel has a pull tab that both rotates the upper panel and simultaneously activates the electronic device upon an initial opening of the upper panel.

6. The closure assembly of claim 1, wherein the beverage container is an aluminum can or a thermoplastic beverage bottle.

* * * * *